US008210267B2

(12) United States Patent
Avant

(10) Patent No.: US 8,210,267 B2
(45) Date of Patent: Jul. 3, 2012

(54) DOWNHOLE PRESSURE CHAMBER AND METHOD OF MAKING SAME

(75) Inventor: Marcus A. Avant, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 396 days.

(21) Appl. No.: 11/757,656

(22) Filed: Jun. 4, 2007

(65) Prior Publication Data

US 2008/0296028 A1 Dec. 4, 2008

(51) Int. Cl.
*E21B 19/16* (2006.01)

(52) U.S. Cl. ..... 166/380; 166/117; 166/162

(58) Field of Classification Search ..... 166/380, 166/117, 162, 319
See application file for complete search history.

(56) References Cited

U.S. PATENT DOCUMENTS

| | | | | |
|---|---|---|---|---|
| 3,813,935 | A | 6/1974 | Tanguy et al. | |
| 4,054,040 | A * | 10/1977 | Medders | 464/18 |
| 4,130,000 | A | 12/1978 | Burge | |
| 4,576,233 | A * | 3/1986 | George | 166/297 |
| 4,597,439 | A | 7/1986 | Meek | |
| 5,033,557 | A | 7/1991 | Askew | |
| 5,230,658 | A * | 7/1993 | Burton | 464/16 |
| 5,911,277 | A * | 6/1999 | Hromas et al. | 166/297 |
| 5,947,204 | A * | 9/1999 | Barton | 166/317 |
| 6,779,600 | B2 | 8/2004 | King et al. | |
| 7,197,923 | B1 | 4/2007 | Wright et al. | |
| 7,562,712 | B2 * | 7/2009 | Cho et al. | 166/319 |

FOREIGN PATENT DOCUMENTS

| | | |
|---|---|---|
| GB | 2 378 723 | 2/2003 |
| WO | 98/54439 | 12/1998 |
| WO | 01/63093 | 8/2001 |

OTHER PUBLICATIONS

Fleckenstein, W.W., et al. "Burst Induced Stresses in Cemented Wellbores," 62696-MS, SPE/AAPG, Western regional Meeting, Long Beach, California, Jun. 19-22, 2000. Abstract having 2 pages.
Fleckenstein, W.W., et al. "Cemented Casing: The True Stress Picture," AADE-05-NTCE-14, Houston, Texas, Apr. 5-7, 2005. 8 pages.
Ethuhoko, M.O., et al. Interventionless Monobore Technology Used to Successfully Complete Challenging Offshore Horizontal Gas-Injection Wells, OTC 17458, Houston, Texas, May 2-5, 2005. 14 pages.
Royle, M. "Standard Operating Procedures for Borehole Packer Testing," 26 pages. Date unknown, retrieved online on Oct. 2, 2008 from: http://www.robertsongeoconsultants.com/hydromine/topics/Site_Assessment/Packer_testing.pdf.
International Search Report with Written Opinion, PCT/US2008/065292, Date mailed Sep. 24, 2008, Search Report having 6 pages, Written Opinion having 6 pages.

* cited by examiner

*Primary Examiner* — Nicole Coy
(74) *Attorney, Agent, or Firm* — Cantor Colburn LLP

(57) ABSTRACT

Disclosed herein is an atmospheric chamber. The atmospheric chamber includes, a first opposing wall of the chamber and a second opposing wall of the chamber, end members sealingly joining the first and second opposing walls of the chamber to create a fluid tight volumetric space, and at least one support substantially bridging between the first opposing wall and the second opposing wall positioned between respective end members.

21 Claims, 5 Drawing Sheets

DOWNHOLE PRESSURE CHAMBER AND METHOD OF MAKING SAME

BACKGROUND OF THE INVENTION

Downhole tools such as actuators, for example, often use downhole hydrostatic pressures to create forces necessary to actuate the actuator. The actuator has a chamber that stores atmospheric pressure. The chamber includes an adjustable volume cavity that when exposed to downhole hydrostatic pressure is compressible to a smaller volume. Actuation is prevented from initiating until the chamber is positioned in a desired downhole location at which point the actuation is triggered. During compression, the actuator causes relative motion between portions thereof that is utilized in the actuation.

Downhole hydrostatic pressures, however, can be so great that the walls that define the pressure cavity of the chamber can fail due to crushing or bursting depending upon the direction in which the hydrostatic pressure is applied. As such, the art may be receptive of pressure chambers with improved resistance to over pressure failures.

BRIEF DESCRIPTION OF THE INVENTION

Disclosed herein is a downhole pressure chamber. The pressure chamber includes, a first tubular having teeth extending from a surface thereof, a second tubular positioned coaxially with the first tubular having teeth extending from a surface thereof, the longitudinal teeth of the second tubular is axially slidably engaged with the surface of the first tubular, and the teeth of the first tubular is axially sidably engaged with the surface of the second tubular. The pressure chamber further includes, a first seal fixedly sealed to the first tubular and slidably sealed to the surface of the second tubular, and a second seal fixedly sealed to the second tubular and slidably sealed to the surface of the first tubular thereby defining a pressure cavity by the first seal, the second seal and an annular space between the two surfaces.

Further disclosed herein is a downhole pressure chamber. The downhole pressure chamber includes, a first tubular having a first end and a second end, a second tubular positioned coaxially with the first tubular having a third end and a fourth end, at least one first seal fixedly sealed to the first tubular at the first end and slidably sealed to an inner perimetrical surface of the second tubular, at least one second seal fixedly sealed to the second tubular at the third end and slidably sealed to an outer perimetrical surface of the first tubular thereby defining a pressure cavity by the at least one first seal, the at least one second seal and an annular space between the inner perimetrical surface and the outer perimetrical surface, and at least one support member positioned within the annular space is slidably engaged with at least one of the inner perimetrical surface and the outer perimetrical surface, the at least one support member is radially supportive of the first tubular and the second tubular.

Further disclosed herein is a method of making a downhole pressure chamber. The method includes, positioning a first tubular having a first end and a second end coaxially with a second tubular having a third end and a fourth end, slidably sealing the first end of the first tubular to an inner surface of the second tubular, slidably sealing the third end of the second tubular to an outer surface of the first tubular thereby defining a pressure cavity in an space between the inner surface, the outer surface and the two seals. The method further includes structurally supporting the first tubular with the second tubular while structurally supporting the second tubular with the first tubular with at least one support member slidably engaged with at least one of the first tubular and the second tubular in the annular space.

Further disclosed herein is an atmospheric chamber. The atmospheric chamber includes, a first opposing wall of the chamber and a second opposing wall of the chamber, end members sealingly joining the first and second opposing walls of the chamber to create a fluid tight volumetric space, and at least one support substantially bridging between the first opposing wall and the second opposing wall positioned between respective end members.

BRIEF DESCRIPTION OF THE DRAWINGS

The following descriptions should not be considered limiting in any way. With reference to the accompanying drawings, like elements are numbered alike.

DESCRIPTION OF THE INVENTION

A detailed description of several embodiments of the disclosed apparatus and method are presented herein by way of exemplification and not limitation with reference to the Figures.

Figure 1:
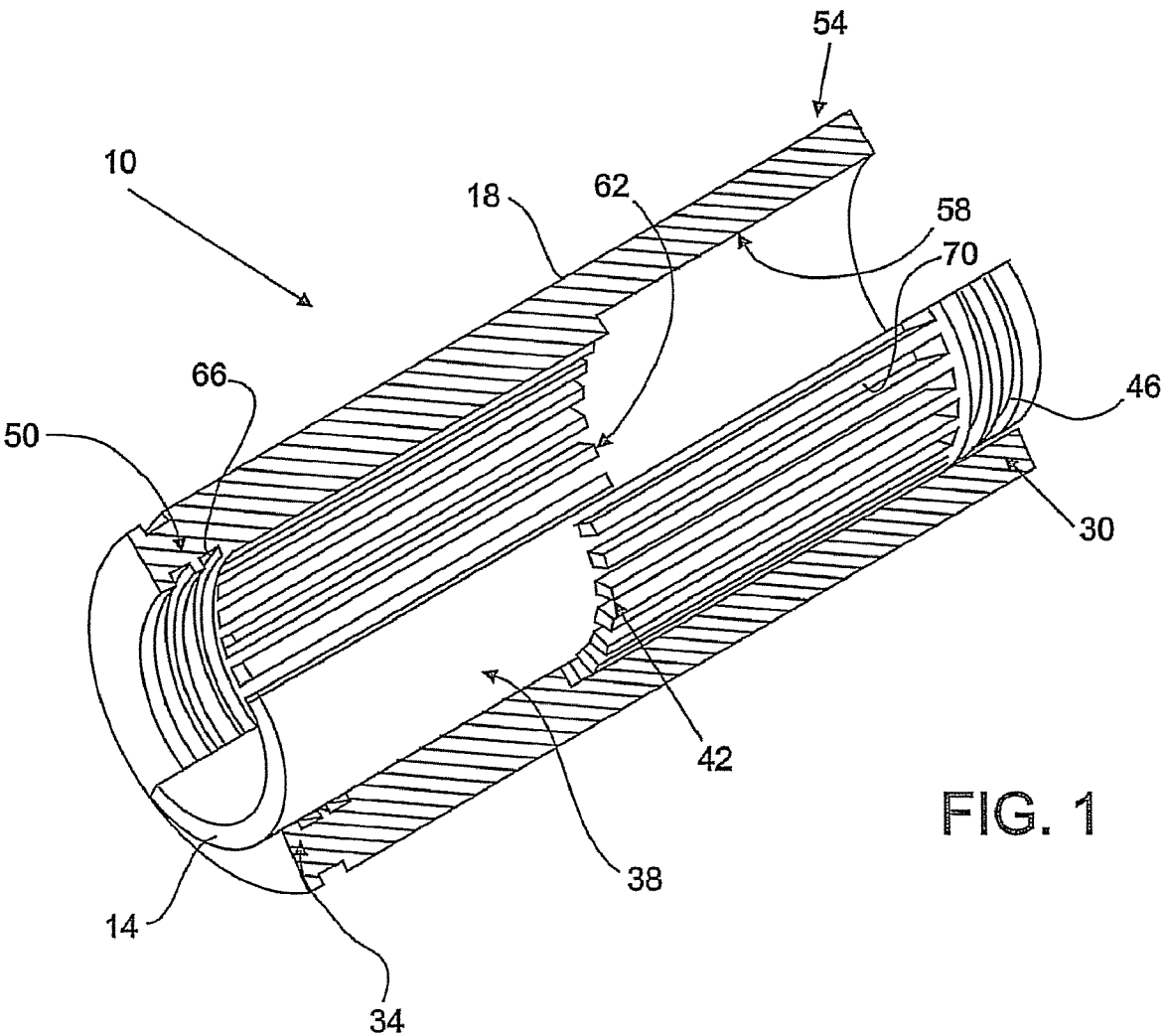
FIG. 1 depicts a partially sectioned perspective view of the downhole pressure chamber disclosed herein.
Figure 2:
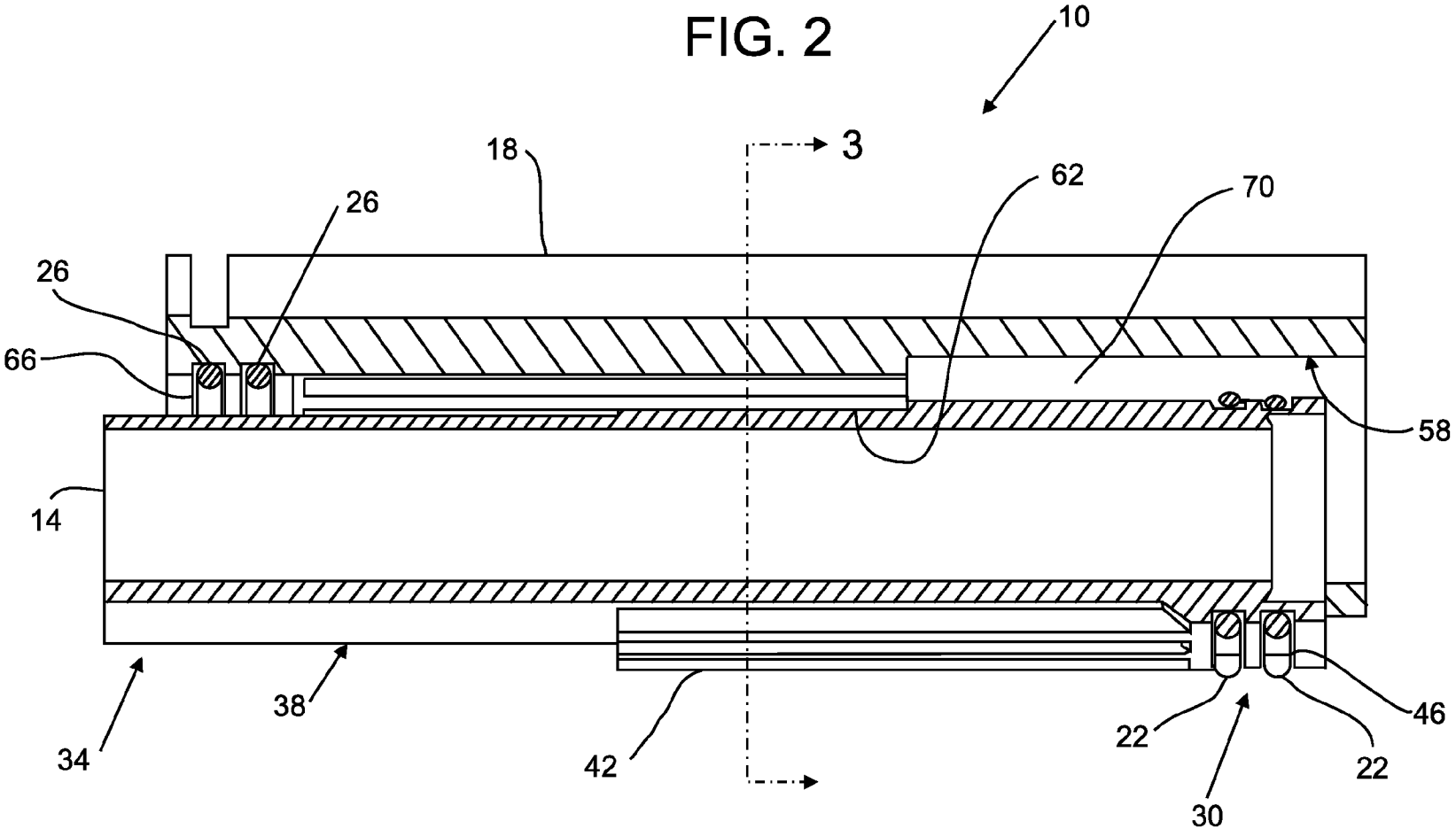
FIG. 2 depicts a side view of the downhole pressure chamber of FIG. 1.

Referring to FIGS. 1 and 2, the downhole pressure chamber 10 disclosed herein is illustrated. The downhole pressure chamber 10 includes a first tubular, disclosed herein as mandrel 14, a second tubular, disclosed herein as housing 18, a first seal 22 and a second seal 26. The mandrel 14 and the housing 18 are made of a rigid material such as metal, for example. The mandrel 14 has a first end 30, a second end 34, an outer perimetrical surface 38, with a plurality of longitudinal teeth 42 extending therefrom, and a pair of perimetrical grooves 46 receptive of the first seal 22, disclosed herein as a pair of o-rings (not shown in FIG. 1). The housing 18 has a third end 50, a fourth end 54, an inner perimetrical surface 58, with a plurality of longitudinal teeth 62 extending therefrom, and a pair of perimetrical grooves 66 receptive of the second seal 26, disclosed herein as a pair of O-rings (not shown in FIG. 1). The first seal 22 slidably seals to the inner perimetrical surface 58 while the second seal 26 slidably seals to the outer perimetrical surface 38, thereby defining a pressure chamber 70 by the inner perimetrical surface 58, the outer perimetrical surface 38, the first seal 22 and the second seal 26. A volume of the pressure cavity 70 changes as the mandrel 14 and housing 18 move axially toward or away from one another. The volume of the pressure cavity 70 is greatest when the first end 30 is as far from the third end 50 as is possible from the sliding engagement of the mandrel 14 with the housing 18. Similarly, the volume of the pressure cavity 70 is smallest when the first end 30 is as near to the third end 50 as is possible from the sliding engagement of the mandrel 14 with the housing 18. As such, the downhole pressure chamber 10 can be used as an actuator by causing the mandrel 14 and the housing 18 to move axially relative to one another in response to pressure differentials between the pressure cavity 70 and a downhole environment external to the pressure cavity 70. For example, if the pressure chamber 10 is positioned downhole with atmospheric pressure within the pressure cavity 70 and downhole hydrostatic pressure is exposed externally to the pressure cavity 70 pressure forces will act to compress the volume of the pressure cavity 70 thereby causing the mandrel 14 to move axially relative to the housing 18. Actuation of the relative motion of the mandrel 14 and the housing 18 is prevented until a triggering event or after release of a release member that may occur based upon a selected pressure differential or simply a particular downhole pressure level.

In an alternate embodiment, not shown, the longitudinal teeth 42 and 62 may be configured in a spiral pattern along the mandrel 14 and the housing 18 respectively. As such, during compression of the pressure cavity 70 the mandrel 14, in addition to moving axially relative to the housing 18 would also move rotationally. Such rotational motion could be utilized to rotationally actuate a tool, for example.

Hydrostatic pressures downhole can reach pressures in the range of about 3,000 to about 20,000 pounds per square-inch (psi). At such extreme pressures the housing 18 and the mandrel 14 are susceptible to crushing or bursting. Embodiments disclosed herein provide support to the housing 18 and mandrel 14 to minimize the possibility of such failures. The housing 18 and the mandrel 14 mutually support one another as will be described below.

Figure 3:
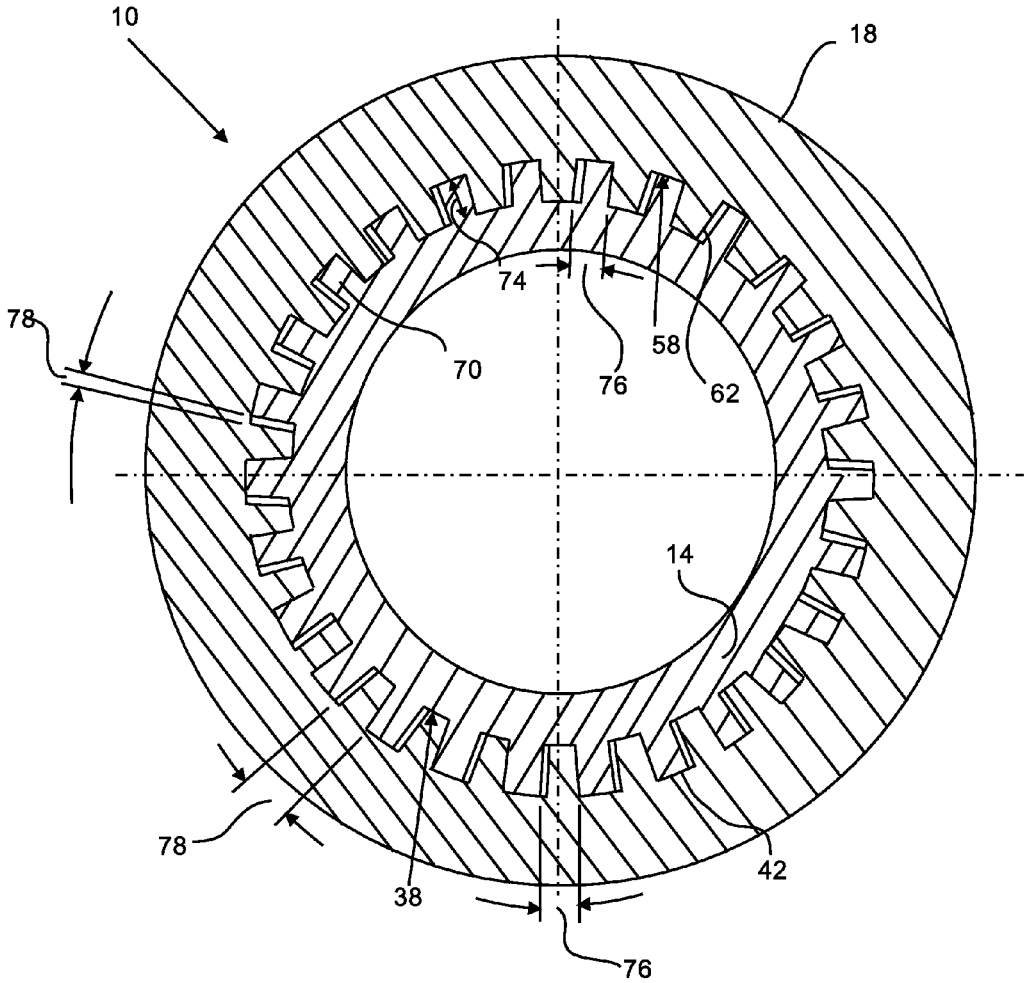
FIG. 3 depicts a cross sectional view of the downhole pressure chamber of FIG. 2 taken at arrows 3-3.

Referring to FIGS. 1, 2, and 3 the longitudinal teeth 42 of the mandrel 14 extend from the outer perimetrical surface 38 a dimension to substantially bridge an annular space 74 that exists between the inner perimetrical surface 58 and the outer perimetrical surface 38. Thus, the longitudinal teeth 42 are in slidable engagement with the inner perimetrical surface 58. Similarly, the longitudinal teeth 62 of the housing 18 extend from the inner perimetrical surface 58 a dimension to substantially bridge the annular space 74 that exists between the inner perimetrical surface 58 and the outer perimetrical surface 38. Thus, the longitudinal teeth 62 are in slidable engagement with the outer perimetrical surface 38. As such, both sets of longitudinal teeth 42, 62 support both the mandrel 14 and the housing 18. Specifically, radially inward movement of the inner perimetrical surface 58 that precedes crushing of the housing 18 by the hydrostatic pressure is counteracted by support of the housing 18 by the mandrel 14 through the teeth 42, 62. Similarly, radially outward movement of the outer perimetrical surface 38 that precedes bursting of the mandrel 14 by the hydrostatic pressure is counteracted by support of the mandrel 14 by the housing 18 through the teeth 42, 62. To assure that an axial portion of the mandrel 14 and housing 18 are not unsupported by the teeth 42, 62 the teeth 42 extend from the first end 30 to beyond midway between the first end 30 and the second end 34, and the teeth 62 extend from the third end 50 to beyond midway between the third end 50 and the fourth end 54. By extending beyond midway between the ends 30, 34, 50, 54 the teeth 42, 62 are assured to overlap axially thereby assuring axial support to the mandrel 14 and the housing 18. Alternate embodiments may, however, have teeth that do not axially overlap as long as the axial gap between the teeth does not exceed specific dimensions as will be described with reference to FIGS. 4 and 5. In order to overlap axially the teeth 42, 62 must be arranged so as not perimetrically interfere with one another. This is accomplished by orienting the teeth 42 to aligned with gaps 76 between the teeth 62, and similarly, to align the teeth 62 with the gaps 76 between the teeth 42.

Perimetrical spacing of the teeth 42, 62 is also important to assure that the teeth 42, 62 are not too far apart to adequately support the mandrel 14 and housing 18. Structural calculations are known in the industry to assure that the housing 18 does not crush under the differential pressure across its tubular structure. Similar structural calculations are known in the industry to assure that the mandrel 14 does not burst under the differential pressure across its tubular structure. These structural calculations among other things include material properties, structural geometry and pressure differentials. With such calculations a safety factor can be determined. Low safety factors such as those less than one, for example, are susceptible to failure if additional support is not provided. In such cases, embodiments disclosed through the teeth 42, 62 or through support rings (to be described with reference to FIGS. 4 and 5 below) can be utilized to provide the additional support needed. For embodiments using the teeth 42, 62 a maximum gap 78 between adjacent teeth 42, 62 should be maintained. One method of calculating the maximum gap 78 is: [((safety factor−1) divided by 0.167)+3] times 5% of the circumference of the tooth outer diameter (OD). This equates to a range of 15% of the circumference of the tooth OD for safety factors of 1 to 0.03% of the circumference of the tooth OD for safety factors of 0.5. Through other calculations the maximum axial unsupported gap is found to be 2 to 4 times the radial thickness of the wall of the housing 18, depending upon the safety factor.

Figure 4:
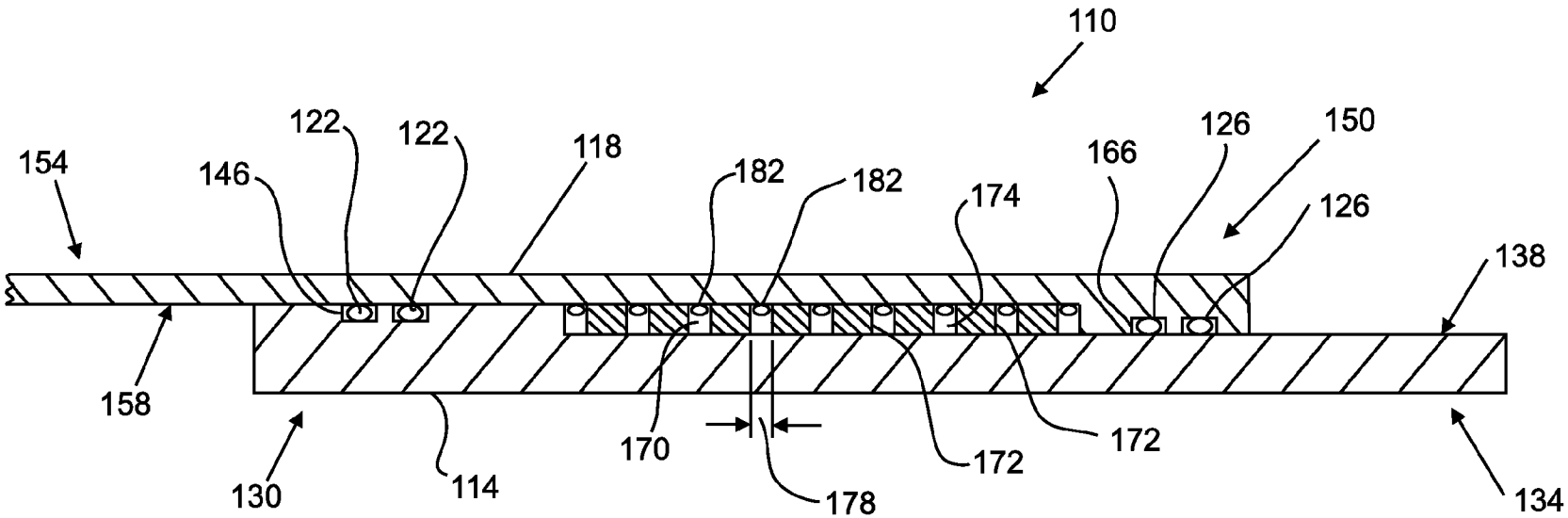
FIG. 4 depicts a partial cross sectional view of an alternate embodiment of the downhole pressure chamber disclosed herein shown in an expanded pressure cavity configuration.
Figure 5:
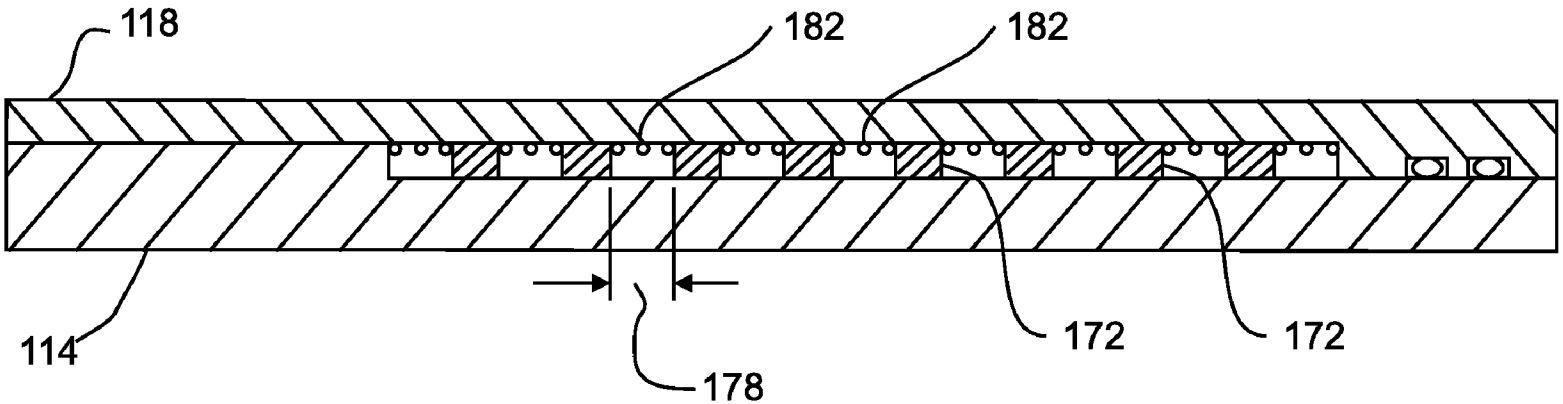
FIG. 5 depicts a partial cross sectional view of the downhole pressure chamber of FIG. 4 shown in a compressed pressure cavity configuration.

Referring to FIGS. 4 and 5, an embodiment of the downhole pressure chamber 110 disclosed herein is illustrated. The downhole pressure chamber 110 includes a first tubular, disclosed herein as mandrel 114, a second tubular, disclosed herein as housing 118, a first seal 122 and a second seal 126. The mandrel 114 and the housing 118 are made of a rigid material such as metal, for example. The mandrel 114 has a first end 130, a second end 134, an outer perimetrical surface 138 and a pair of perimetrical grooves 146 receptive of the first seal 122, disclosed herein as a pair of o-rings. The housing 118 has a third end 150, a fourth end 154, an inner perimetrical surface 158 and a pair of perimetrical grooves 166 receptive of the second seal 126, disclosed herein as a pair of o-rings. The first seal 122 slidably seals to the inner perimetrical surface 158 while the second seal 126 slidably seals to the outer perimetrical surface 138, thereby defining a pressure chamber 170 by the inner perimetrical surface 138, the outer perimetrical surface 138, the first seal 122 and the second seal 126. A volume of the pressure cavity 170 changes as the mandrel 114 and housing 118 move axially toward or away from one another. The volume of the pressure cavity 170 is greatest when the first end 130 is as far from the third end 150 as is possible from the sliding engagement of the mandrel 114 with the housing 118. Similarly, the volume of the pressure cavity 170 is smallest when the first end 130 is as near to the third end 150 as is possible from the sliding engagement of the mandrel 114 with the housing 118. As such, the downhole pressure chamber 110 can be used as an actuator by causing the mandrel 114 and the housing 118 to move axially relative to one another in response to pressure differentials between the pressure cavity 170 and a downhole environment external to the pressure cavity 170. For example, if the pressure chamber 110 is positioned downhole with atmospheric pressure within the pressure cavity 170 and downhole hydrostatic pressure is exposed externally to the pressure cavity 170 pressure forces will act to compress the volume of the pressure cavity 170 thereby causing the mandrel 114 to move axially relative to the housing 118.

Wherein radial support for the mandrel 14 and housing 18 of the embodiment of FIGS. 1-3 was through a plurality of teeth 42, 62, the embodiments of FIGS. 4 and 5 support the mandrel 114 and housing 118 through at least one support ring 174. The support rings 172 are positioned in an annular space 174 defined by the perimetrical surfaces 138 and 158. The support rings 172 are dimensioned to substantially bridge the annular space 174 and are in slidable engagement with the perimetrical surface 138 and 158. As such the support rings 172 radially support both the mandrel 114 and the housing 118. Specifically, radially inward movement of the inner perimetrical surface 158 that precedes crushing of the housing 118, by the hydrostatic pressure, is counteracted by support of the housing 118 by the mandrel 114 through the support rings 172. Similarly, radially outward movement of the outer perimetrical surface 138 that precedes bursting of the mandrel 114, by the hydrostatic pressure, is counter acted by support of the mandrel 114 by the housing 118 through the support rings 172. To assure that the mandrel 114 and housing 118 are adequately supported by the support rings 172 the support rings 172 are positioned along the annular space 174 with an axial gap 178 of no more than about 2 to about 4 times the radial thickness of the housing 118 as described above.

Since the support rings 172 are slidably engaged with both the mandrel 114 and the housing 118, the support rings 172 are free to move axially within the annular space 174. A plurality of biasing members 182, disclosed herein as coil springs, are positioned on both sides of each of the support rings 172. The plurality of biasing members 182 provide substantially equal forces to the support rings 172 such that each of the biasing members 182 maintain substantially equal length with one another. The equal lengths of the biasing members 182 centers the support rings 172 such that an equal distance is maintained on each axial side of the support rings 172. Maintaining substantially equal lengths of the biasing members 182 allows a designer of the system to design in the axial gap 178 such that it does not exceed a desired maximum dimension.

Additionally, the support rings 172 have one or more recesses (not shown) in at least an inner radial surface or an outer radial surface thereof or other openings facilitative of pressure communication to the next adjacent pocket of fluid to prevent sealing of the support rings 172 to the perimetrical surfaces 138, 158 that could create undesirable pressure pockets between adjacent support rings 172, for example.

In an alternate embodiment of the pressure chamber, not shown, support members could be fixedly attached to both a mandrel and a housing such that they bridge an annular space therebetween. Such support members may be raised surfaces that slidably engage with one another at a radial interface therebetween, for example. In so doing the support members provide radial support to both the mandrel and the housing. In such an embodiment, however, the relative movement of actuation of the mandrel with the housing would be limited to the dimension of the maximum axial gap as described in reference to FIGS. 4 and 5. This limitation will assure that neither the mandrel nor the housing have an excessive non-supported portion.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

The invention claimed is:

1. A downhole pressure chamber, comprising:

a first tubular having a first end, a second end and a plurality of longitudinal teeth extending radially outwardly from an outer perimetrical surface thereof, the plurality of longitudinal teeth extending longitudinally from the first end to approximately midway between the first end and the second end;

a second tubular positioned coaxially with the first tubular having a third end, a fourth end and a plurality of longitudinal teeth extending radially inwardly from an inner perimetrical surface thereof, the plurality of longitudinal teeth extending longitudinally from the third end to approximately midway between the third end and the fourth end, the plurality of longitudinal teeth of the second tubular being axially slidably engaged with the outer perimetrical surface of the first tubular, and the plurality of longitudinal teeth of the first tubular being axially slidably engaged with the inner perimetrical surface of the second tubular, the plurality of longitudinal teeth of the first tubular being longitudinally overlapable with the plurality of longitudinal teeth of the second tubular and the plurality of longitudinal teeth of the first tubular being positioned perimetrically in spaces between the plurality of longitudinal teeth of the second tubular;

at least one first seal fixedly sealed to the first tubular at the first end and slidably sealed to the inner perimetrical surface of the second tubular; and at least one second seal fixedly sealed to the second tubular at the third end and slidably sealed to the outer perimetrical surface of the first tubular thereby defining a pressure cavity by the at least one first seal, the at least one second seal and an annular space between the inner perimetrical surface and the outer perimetrical surface.

2. The downhole pressure chamber of claim 1, wherein a volume of the pressure cavity is greatest when the first end and the third end are positioned as far apart as the slidable engagement of the first tubular with the second tubular will permit, and the pressure cavity is smallest when the first end and the third end are positioned as close together as the slidable engagement of the first tubular with the second tubular will permit.

3. The downhole pressure chamber of claim 1, wherein at least one of the first tubular and the second tubular are metal.

4. The downhole pressure chamber of claim 1, wherein contact between the plurality of longitudinal teeth of the first tubular and the inner radial surface of the second tubular and contact between the plurality of longitudinal teeth of the second tubular with the outer radial surface of the first tubular support the first tubular to minimize deformation of the first tubular in a radially outward direction due to pressure acting on an inner radial surface of the first tubular, and support the second tubular to minimize deformation of the second tubular in a radially inward direction due to pressure acting on an outer radial surface of the second tubular.

5. The downhole pressure chamber of claim 1, wherein the overlapable plurality of longitudinal teeth overlap at all relative positions of the first tubular with the second tubular.

6. The downhole pressure chamber of claim 1, wherein the plurality of longitudinal teeth of at least one of the first tubular and the second tubular are substantially equidistantly spaced from one another about the perimetrical surface from which they extend.

7. The downhole pressure chamber of claim 1, wherein a maximum perimetrical gap between adjacent teeth of the plurality of teeth is in a range of about 15% to about 0.03% of the circumference of the outer surface.

8. The downhole pressure chamber of claim 1, wherein at least one of the first seal and the second seal is at least one o-ring.

9. The downhole pressure chamber of claim 8, wherein the at least one o-ring is fixed sealed with a groove in one of the first tubular and the second tubular.

10. The downhole pressure chamber of claim 1, wherein the pressure cavity is containable of a gas.

11. The downhole pressure chamber of claim 1, wherein a volume of the pressure cavity is variable in response to a pressure differential between an inside of the pressure cavity and an outside of the pressure cavity.

12. The downhole pressure chamber of claim 1, wherein the longitudinal teeth of the first tubular include a rotational component and the longitudinal teeth of the second tubular include a rotational component such that axial movement of the first tubular relative to the second tubular includes rotational movement of the first tubular relative to the second tubular.

13. A downhole pressure chamber, comprising:

a first tubular having a first end and a second end;

a second tubular positioned coaxially with the first tubular having a third end and a fourth end;

at least one first seal fixedly sealed to the first tubular at the first end and slidably sealed to an inner perimetrical surface of the second tubular;

at least one second seal fixedly sealed to the second tubular at the third end and slidably sealed to an outer perimetrical surface of the first tubular thereby defining a pressure cavity by the at least one first seal, the at least one second seal and an annular space between the inner perimetrical surface and the outer perimetrical surface; and a plurality of longitudinal teeth positioned within the annular space being slidably engaged with at least one of the inner perimetrical surface and the outer perimetrical surface, the plurality of longitudinal teeth spanning from the first seal to the second seal.

14. The downhole pressure chamber of claim 13, wherein the at least one support member is a ring.

15. The downhole pressure chamber of claim 14, further comprising at least one biasing member positioned on at least one axial side of the at least one ring, the at least one biasing member being in operable communication with the at least one ring to thereby position the at least one ring such that a substantially equidistance is maintained on both axial sides of each of the at least one ring.

16. The downhole pressure chamber of claim 14, wherein a largest gap between adjacent at least one ring is in the range of 2 to 4 times the radial thickness of the second tubular.

17. The downhole pressure chamber of claim 14, wherein the at least one ring has at least one recess in at least one of an inner perimetrical surface thereof and an outer perimetrical surface thereof.

18. A method of making a downhole pressure chamber, comprising:

positioning a first tubular having a first end and a second end coaxially with a second tubular having a third end and a fourth end;

slidably sealing the first end of the first tubular to an inner surface of the second tubular;

slidably sealing the third end of the second tubular to an outer surface of the first tubular thereby defining a pressure cavity in an space between the inner surface, the outer surface and the two seals; and structurally supporting the first tubular with the second tubular while structurally supporting the second tubular with the first tubular with a plurality of longitudinal teeth slidably engaged with at least one of the first tubular and the second tubular in the annular space, the plurality of longitudinal teeth spanning between the two seals.

19. The method of making a downhole pressure chamber of claim 18, wherein the structurally supporting further comprises positioning at least one ring in the space that slidable engages both the inner surface and the outer surface.

20. The method of making a downhole pressure chamber of claim 19, wherein the positioning at least one ring further comprises biasing the at least one ring to maintain equidistance on opposing sides of the at least one ring and others of the at least one ring or ends of the inner surface or the outer surface.

21. An atmospheric chamber comprising:

a first opposing wall of the chamber and a second opposing wall of the chamber;

end members sealingly joining the first and second opposing walls of the chamber to create a fluid tight volumetric space; and a plurality of longitudinal teeth substantially bridging between the first opposing wall and the second opposing wall being slidably engaged with at least one of a first perimetrical surface of the first opposing wall and a second perimetrical surface of the second opposing wall and spanning from one end member to the opposing end member.

* * * * *